US007420528B2

(12) United States Patent
Lee

(10) Patent No.: US 7,420,528 B2
(45) Date of Patent: Sep. 2, 2008

(54) DRIVING A PLASMA DISPLAY PANEL (PDP)

(75) Inventor: Joo-Yul Lee, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 737 days.

(21) Appl. No.: 10/989,082

(22) Filed: Nov. 16, 2004

(65) Prior Publication Data

US 2005/0110709 A1 May 26, 2005

(30) Foreign Application Priority Data

Nov. 24, 2003 (KR) ..... 10-2003-0083603

(51) Int. Cl.
*G09G 3/28* (2006.01)

(52) U.S. Cl. ..... 345/60

(58) Field of Classification Search ..... 345/60–72, 345/211; 315/169.4; 313/581–587
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 6,833,823 | B2 * | 12/2004 | Sakita | 345/60 |
| 7,006,057 | B2 * | 2/2006 | Jin et al. | 345/60 |
| 2003/0057851 | A1 * | 3/2003 | Roh et al. | 315/169.2 |

FOREIGN PATENT DOCUMENTS

| | | |
|---|---|---|
| JP | 02-148645 | 6/1990 |
| JP | 10-123998 | 5/1998 |
| JP | 2845183 | 10/1998 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Amr Awad
*Assistant Examiner*—Randal Willis
(74) *Attorney, Agent, or Firm*—Robert E. Bushnell, Esq.

(57) ABSTRACT

In driving a Plasma Display Panel (PDP), when a driving operation moves from an address period to a sustain period, low-voltage driving switches of all of the scan ICs are turned on at the same time after the drain voltage and source voltage of each of them are made equal via a power recovery circuit under the condition that the outputs of the scan ICs are floating. Therefore, when the switches are turned on, no current flows therethrough, thereby making it possible to solve instability of a driving circuit and noise and EMI therein.

12 Claims, 7 Drawing Sheets

FOREIGN PATENT DOCUMENTS

| | | |
|---|---|---|
| JP | 2917279 | 4/1999 |
| JP | 2000-250485 | 9/2000 |
| JP | 2000-293135 | 10/2000 |
| JP | 2000-338934 | 12/2000 |
| JP | 2001-043804 | 2/2001 |
| JP | 2001-228821 | 8/2001 |
| JP | 2001-325888 | 11/2001 |
| JP | 2002-062843 | 2/2002 |
| JP | 2002-215091 | 7/2002 |
| JP | 2002-366098 | 12/2002 |
| JP | 2003-015602 | 1/2003 |
| JP | 2003-255892 | 9/2003 |
| JP | 2003-280574 | 10/2003 |
| JP | 2003-295817 | 10/2003 |

* cited by examiner

DRIVING A PLASMA DISPLAY PANEL (PDP)

CLAIM OF PRIORITY

This application makes reference to, incorporates the same herein, and claims all benefits accruing under 35 U.S.C. §119 from an application for APPARATUS AND METHOD FOR DRIVING PLASMA DISPLAY PANEL earlier filed in the Korean Intellectual Property Office on 24 Nov. 2003 and there duly assigned Serial No. 10-2003-0083603.

BACKGROUND OF THE INVENTION

1. Field of the Invention

The present invention relates to driving a Plasma Display Panel (PDP).

2. Description of the Related Art

Recently, PDPs are being highlighted as flat panel displays in that they are superior to other flat panel displays with regard to high luminance, high luminous efficiency and a wide viewing angle.

A PDP uses a plasma generated by a gas discharge to display characters or images. The PDP includes, according to its size, more than several tens to millions of pixels arranged in the form of a matrix.

The PDP includes two glass substrates spaced apart from each other to face each other. Scan electrodes and sustain electrodes, which are covered with a dielectric layer and a protection film, are formed in pairs in parallel on the glass substrate. A plurality of address electrodes, which are covered with an insulation layer, are also formed on the glass substrate. Barrier ribs are formed in parallel with the address electrodes on the insulation layer such that each rib is interposed between adjacent address electrodes. A phosphor is coated on the surface of the insulation layer and on both sides of each of the barrier ribs. The glass substrates are arranged to face each other while defining a discharge space therebetween so that the address electrodes are orthogonal to the scan electrodes and sustain electrodes. In the discharge space, discharge cells are respectively formed at intersections between the address electrodes and the pairs of scan electrodes and sustain electrodes.

The electrodes of the PDP are arranged in the form of an n×m matrix. That is, a plurality of address electrodes A1 to Am are arranged in a column direction, and a plurality of scan electrodes Y1 to Yn and a plurality of sustain electrodes X1 to Xn are arranged in pairs in a row direction.

In the PDP, one frame is divided into a plurality of sub-fields that are combined to express a gray scale. Each of the sub-fields is composed of a reset period, an address period and a sustain period.

In the reset period, wall charges formed by a previous sustain discharge are erased. Also, wall charges are set up to stably perform a next address discharge. In the address period, cells that are turned on and cells that are not turned on are selected in the panel, and wall charges are accumulated on the turned-on cells (i.e., addressed cells). In the sustain period, a sustain discharge occurs to actually display an image on the addressed cells.

Here, the term "wall charges" refers to charges that are formed proximate to the electrodes on the wall (for example, dielectric layer) of the discharge cells and stored on the electrodes. The wall charges do not actually touch the electrodes themselves because the dielectric layer covers the electrodes. However, for simplicity of description, the charges will be described herein as being "formed on", "stored on" and/or "accumulated on" the electrodes. Furthermore, the term "wall voltage" refers to a potential difference that is generated on the wall of the discharge cells by the wall charges.

In the PDP, a driving operation moves from the address period to the sustain period after dropping voltages at the Y electrodes to 0V at the end of the address period.

In order to drop all of the Y electrode voltages to 0V at the same time, low-voltage driving switches of all scan ICs are turned on at the same time, thereby causing a very large amount of current to instantaneously flow in the scan ICs, resulting in noise and ElectroMagnetic Interference (EMI) in a driving circuit as well as instability of the driving circuit.

SUMMARY OF THE INVENTION

Therefore, it is an aspect of the present invention to provide an apparatus to drive a plasma display panel, which is capable of reducing EMI and noise by changing a current path when a driving operation moves from an address period to a sustain period.

In accordance with one aspect of the present invention, a method of driving a Plasma Display Panel (PDP)is provided, the method comprising: providing a plurality of first electrodes and a plurality of second electrodes; sequentially selecting the plurality of first electrodes and supplying a first voltage to a selected one of the first electrodes and a second voltage to all of the other first electrodes; floating the first electrodes while supplying the second voltage to the first electrodes; and changing a voltage at each of the first electrodes to a third voltage for a sustain discharge.

Changing a voltage at each of the first electrodes to a third voltage for a sustain discharge preferably includes maintaining a voltage at each of the second electrodes at a fourth voltage, and wherein the fourth voltage is supplied to the second electrodes upon the first electrodes being selected.

The method preferably further comprises, after changing a voltage at each of the first electrodes to a third voltage for a sustain discharge, changing the voltage at each of the second electrodes from the fourth voltage to a fifth voltage, the fifth voltage being a voltage whose difference with respect to the third voltage supplied to the first electrodes causes the sustain discharge.

The method preferably further comprises: between floating the first electrodes while supplying the second voltage to the first electrodes and changing a voltage at each of the first electrodes to a third voltage for a sustain discharge, changing the voltage at each of the second electrodes from the fourth voltage to a fifth voltage; and changing the voltage at each of the first electrodes from the second voltage to the fifth voltage.

The method preferably further comprises: supplying the fourth voltage to the second electrodes upon the first electrodes being selected; wherein the fifth voltage is a voltage whose difference with respect to the third voltage supplied to the first electrodes causes the sustain discharge.

In accordance with another aspect of the present invention, a method of driving a Plasma Display Panel (PDP) is provided, the method comprising: providing a plurality of first electrodes, a plurality of second electrodes, and a plurality of selection circuits respectively coupled to the first electrodes, wherein each of the selection circuits includes a first transistor having a source or drain coupled to a corresponding one of the first electrodes, and a second transistor having a source or drain coupled to the corresponding first electrode; sequentially selecting the first electrodes, and supplying a first voltage to a selected one of the first electrodes through a body diode of a corresponding one of the second transistors and respectively supplying a second voltage to all of the other first electrodes through body diodes of corresponding ones of the first transistors; turning off the first and second transistors of the selection circuits; respectively supplying a third voltage adapted to cause a sustain discharge to the first electrodes through body diodes of the second transistors; and turning on the second transistors of the selection circuits, wherein the first voltage is supplied to the selected first electrode upon the corresponding second transistor being turned on, and the second voltage is supplied to all of the other first electrodes upon the corresponding first transistors being turned on.

Respectively supplying a third voltage adapted to cause a sustain discharge to the first electrodes through body diodes of the second transistors preferably includes maintaining a voltage at each of the second electrodes at a fourth voltage, the fourth voltage being preferably supplied to the second electrodes upon the first electrodes being selected.

The method preferably further comprises, after respectively supplying a third voltage to cause a sustain discharge to the first electrodes through body diodes of the second transistors, changing the voltage at each of the second electrodes from the fourth voltage to a fifth voltage, wherein the fifth voltage is a voltage whose difference with the third voltage supplied to the first electrodes causes the sustain discharge.

The method preferably further comprises: between turning off the first and second transistors of the selection circuits and respectively supplying a third voltage to cause a sustain discharge to the first electrodes through body diodes of the second transistors, changing the voltage at each of the second electrodes from the fourth voltage to a fifth voltage; and changing a voltage at each of the first electrodes from the second voltage to the fifth voltage.

Turning on the second transistors of the selection circuits preferably includes turning on each of the second transistors while the voltage at each of the first electrodes is maintained at the third voltage.

Turning on the second transistors of the selection circuits preferably includes setting a source voltage and drain voltage of each of the second transistors to be equal when each of the second transistors is turned on.

In accordance with another aspect of the present invention, a Plasma Display Panel (PDP) drive apparatus is provided comprising: a plurality of first electrodes, a plurality of second electrodes, and a panel capacitor formed by each of the first electrodes and each of the second electrodes; a first sustain driver adapted to supply a voltage for a sustain discharge to the first electrodes; a plurality of selection circuits adapted to sequentially supply a scan voltage to the first electrodes during an address period, each of the selection circuits including a first transistor having a first terminal coupled to a corresponding one of the first electrodes and a second terminal, and a second transistor having a first terminal and a second terminal coupled to the corresponding first electrode; a first voltage source adapted to respectively supply the scan voltage to the first electrodes through the second transistors; and a second voltage source adapted to respectively supply a first voltage to ones of the first electrodes other than a first electrode supplied with the scan voltage in the address period, through corresponding ones of the first transistors; wherein the sustain discharge voltage is supplied to the first electrodes through the first sustain driver and respective body diodes of the second transistors; wherein the second transistors are then turned on when the first and second transistors are turned off after the scan voltage has been sequentially supplied to the first electrodes; and wherein the first voltage is then supplied to the first electrodes.

The first sustain driver preferably includes: a first inductor having a first end coupled to the second terminal of each of the second transistors; a third transistor coupled between a second end of the first inductor and a third voltage source adapted to supply a second voltage; and a fourth transistor coupled between each of the first electrodes and a fourth voltage source adapted to supply a third voltage; wherein the first electrodes are charged upon the third transistor being turned on when the first and second transistors are turned off; and wherein the third voltage is then supplied to the first electrodes upon the fourth transistor being turned on.

The second electrodes are preferably maintained at a fourth voltage while the first electrodes are charged to the third voltage, and the fourth voltage is preferably supplied to the second electrodes during the address period.

The apparatus preferably further comprises a second sustain driver adapted to supply a voltage for a sustain discharge to the second electrodes, the second sustain driver including: a second inductor having a first end coupled to each of the second electrodes; a fifth transistor coupled between a second end of the second inductor and a fifth voltage source adapted to supply a fifth voltage; and a sixth transistor coupled between each of the second electrodes and a sixth voltage source adapted to supply a sixth voltage; wherein the second electrodes are discharged upon the fifth transistor being turned on when the first and second transistors are turned off; wherein the sixth voltage is supplied to the second electrodes upon the sixth transistor being turned on; and wherein the third voltage is then supplied to the first electrodes upon the third transistor being turned on.

The apparatus preferably further comprises: a first diode coupled between the second end of the first inductor and the third voltage source to determine a direction of current to charge the panel capacitor; and a second diode coupled between the second end of the second inductor and the fifth voltage source to determine a direction of current to discharge the panel capacitor.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
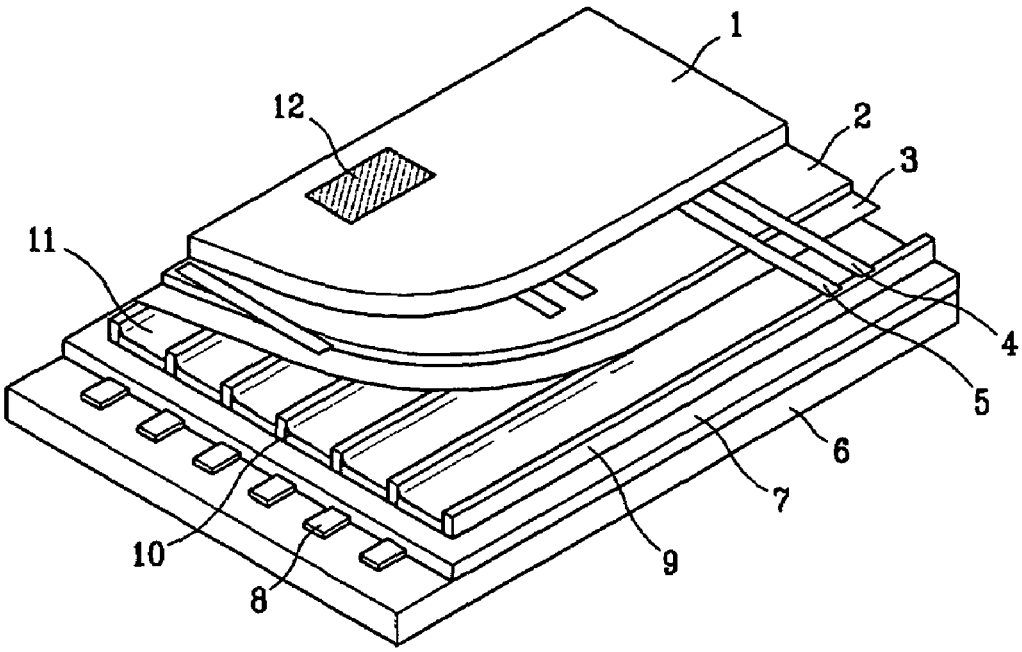
FIG. 1 is a partial perspective view of a PDP.
Figure 2:
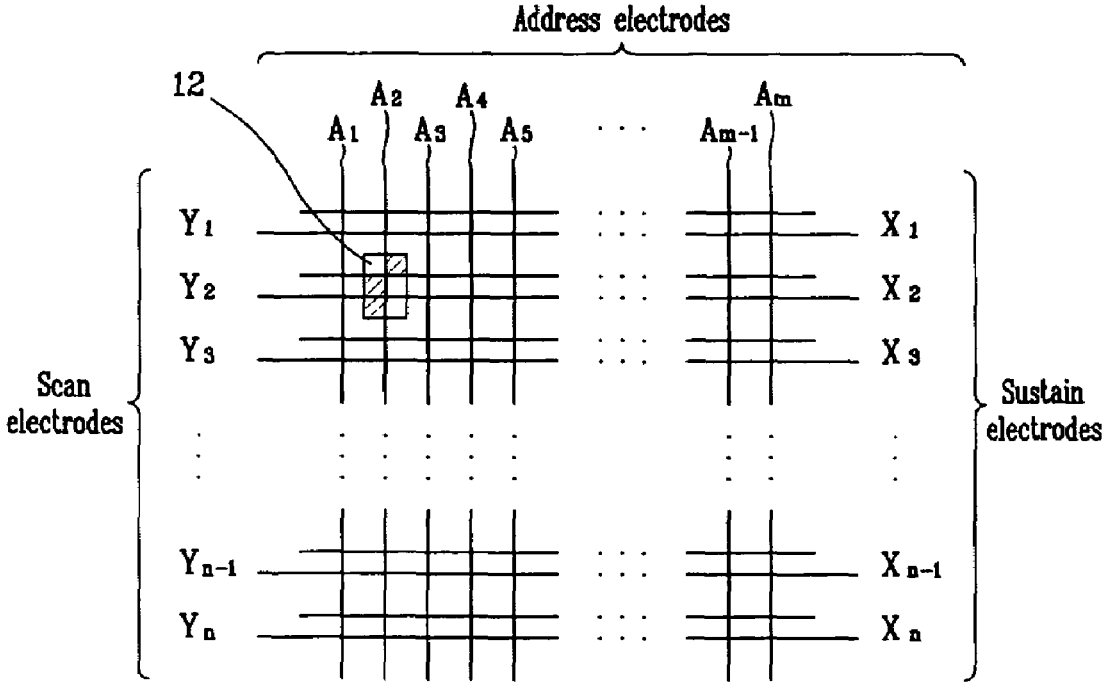
FIG. 2 is a view of an arrangement of electrodes in the PDP of FIG. 1.

FIG. 1 is a partial perspective view of a PDP, and FIG. 2 is a view of an arrangement of electrodes in the PDP of FIG. 1.

As shown in FIG. 1, the PDP includes two glass substrates 1 and 6 spaced apart from each other to face each other. Scan electrodes 4 and sustain electrodes 5, which are covered with a dielectric layer 2 and a protection film 3, are formed in pairs in parallel on the glass substrate 1. A plurality of address electrodes 8, which are covered with an insulation layer 7, are also formed on the glass substrate 6. Barrier ribs 9 are formed in parallel with the address electrodes 8 on the insulation layer 7 such that each rib is interposed between adjacent address electrodes 8. A phosphor 10 is coated on the surface of the insulation layer 7 and on both sides of each of the barrier ribs 9. The glass substrates 1 and 6 are arranged to face each other while defining a discharge space 11 therebetween so that the address electrodes 8 are orthogonal to the scan electrodes 4 and sustain electrodes 5. In the discharge space 11, discharge cells 12 are respectively formed at intersections between the address electrodes 8 and the pairs of scan electrodes 4 and sustain electrodes 5.

As shown in FIG. 2, the electrodes of the PDP are arranged in the form of an n×m matrix. That is, a plurality of address electrodes A1 to Am are arranged in a column direction, and a plurality of scan electrodes Y1 to Yn and a plurality of sustain electrodes X1 to Xn are arranged in pairs in a row direction.

In the PDP, one frame is divided into a plurality of sub-fields that are combined to express a gray scale. Each of the sub-fields is composed of a reset period, an address period and a sustain period.

In the reset period, wall charges formed by a previous sustain discharge are erased. Also, wall charges are set up to stably perform a next address discharge. In the address period, cells that are turned on and cells that are not turned on are selected in the panel, and wall charges are accumulated on the turned-on cells (i.e., addressed cells). In the sustain period, a sustain discharge occurs to actually display an image on the addressed cells.

Here, the term "wall charges" refers to charges that are formed proximate to the electrodes on the wall (for example, dielectric layer) of the discharge cells and stored on the electrodes. The wall charges do not actually touch the electrodes themselves because the dielectric layer covers the electrodes. However, for simplicity of description, the charges will be described herein as being "formed on", "stored on" and/or "accumulated on" the electrodes. Furthermore, the term "wall voltage" refers to a potential difference that is generated on the wall of the discharge cells by the wall charges.

Figure 3:
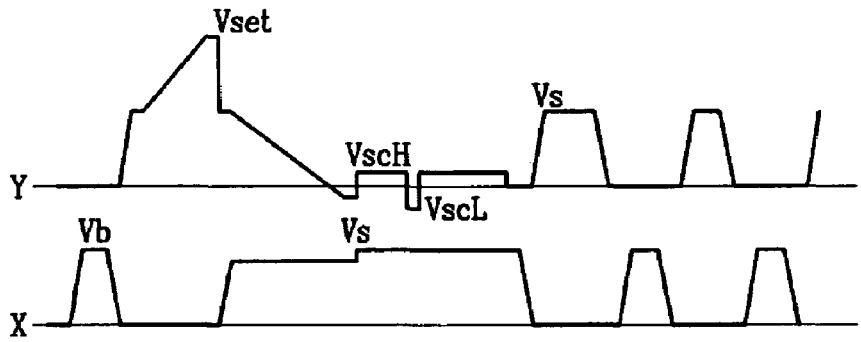
FIG. 3 is a waveform diagram of driving waveforms of the PDP of FIG. 1.

FIG. 3 is a view of X and Y electrode waveforms of the PDP of FIG. 1.

In the PDP, a driving operation moves from the address period to the sustain period after dropping voltages at the Y electrodes to 0V at the end of the address period, as shown in FIG. 3.

In order to drop all of the Y electrode voltages to 0V at the same time, low-voltage driving switches of all scan ICs are turned on at the same time, thereby causing a very large amount of current to instantaneously flow in the scan ICs, resulting in noise and ElectroMagnetic Interference (EMI) in a driving circuit as well as instability of the driving circuit.

In the following detailed description, only certain exemplary embodiments of the present invention are shown and described, by way of illustration. As those skilled in the art would recognize, the described exemplary embodiments may be modified in various ways without departing from the spirit or scope of the present invention. Accordingly, the drawings and description are to be regarded as illustrative in nature, rather than restrictive. In the drawings, illustrations of elements having no relation to the present invention are omitted in order to prevent the subject matter of the present invention from being unclear. In the specification, the same or similar elements are denoted by the same reference numerals throughout the drawings.

The configuration of a PDP according to an embodiment of the present invention will be described in detail with reference to FIG. 4.

Figure 4:
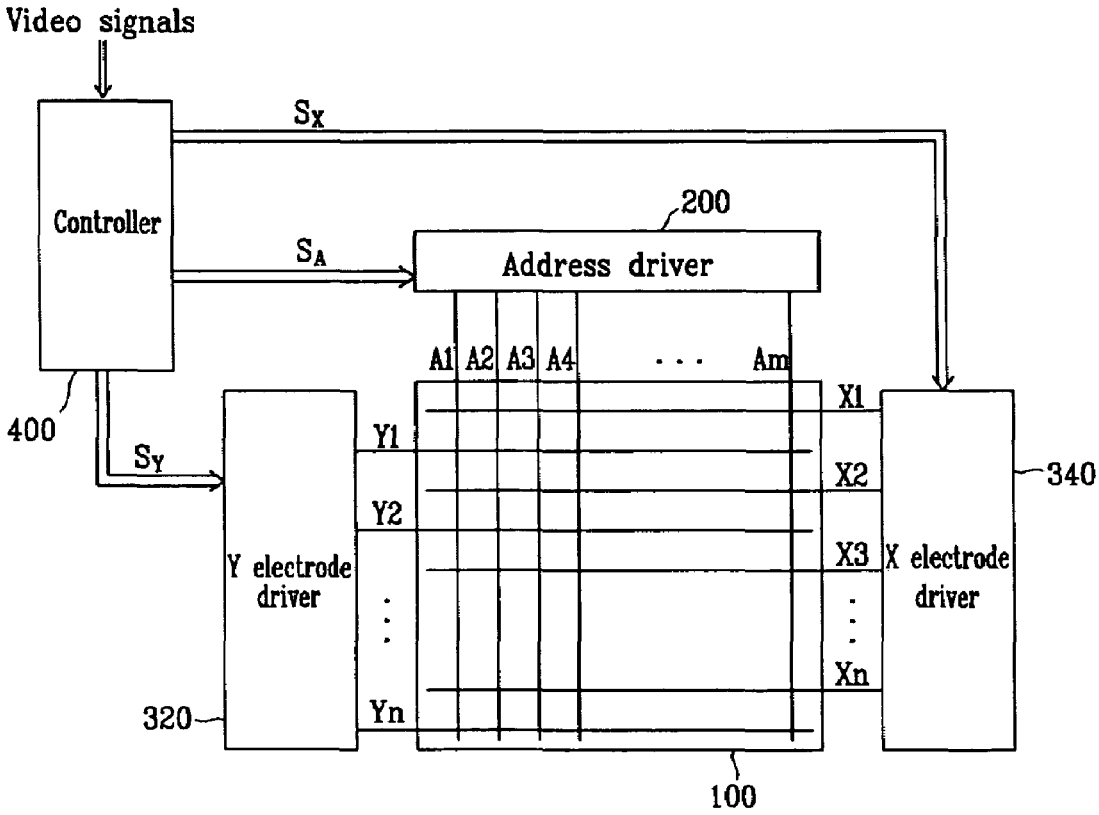
FIG. 4 is a view of the configuration of a PDP according to an embodiment of the present invention.

As shown in FIG. 4, a PDP according to an embodiment of the present invention comprises a plasma panel 100, an address driver 200, a Y electrode driver 320, an X electrode driver 340 and a controller 400.

The plasma panel 100 includes a plurality of address electrodes A1 to Am arranged in a column direction, and a plurality of first electrodes Y1 to Yn (referred to hereinafter as Y electrodes) and a plurality of second electrodes X1 to Xn (referred to hereinafter as X electrodes) arranged in a row direction.

The address driver 200 receives an address driving control signal SA from the controller 400, and supplies display data signals to the respective address electrodes A1 to Am to select desired discharge cells.

The Y electrode driver 320 and the X electrode driver 340 receive a Y electrode driving signal SY and an X electrode driving signal SX from the control unit 400, and respectively supply driving voltages to the X electrodes and the Y electrodes.

The control unit 400 externally receives a video signal, generates the address driving control signal SA, Y electrode driving signal SY and X electrode driving signal SX, and respectively transfers the generated signals to the address driver 200, Y electrode driver 320 and X electrode driver 340.

Figure 5:
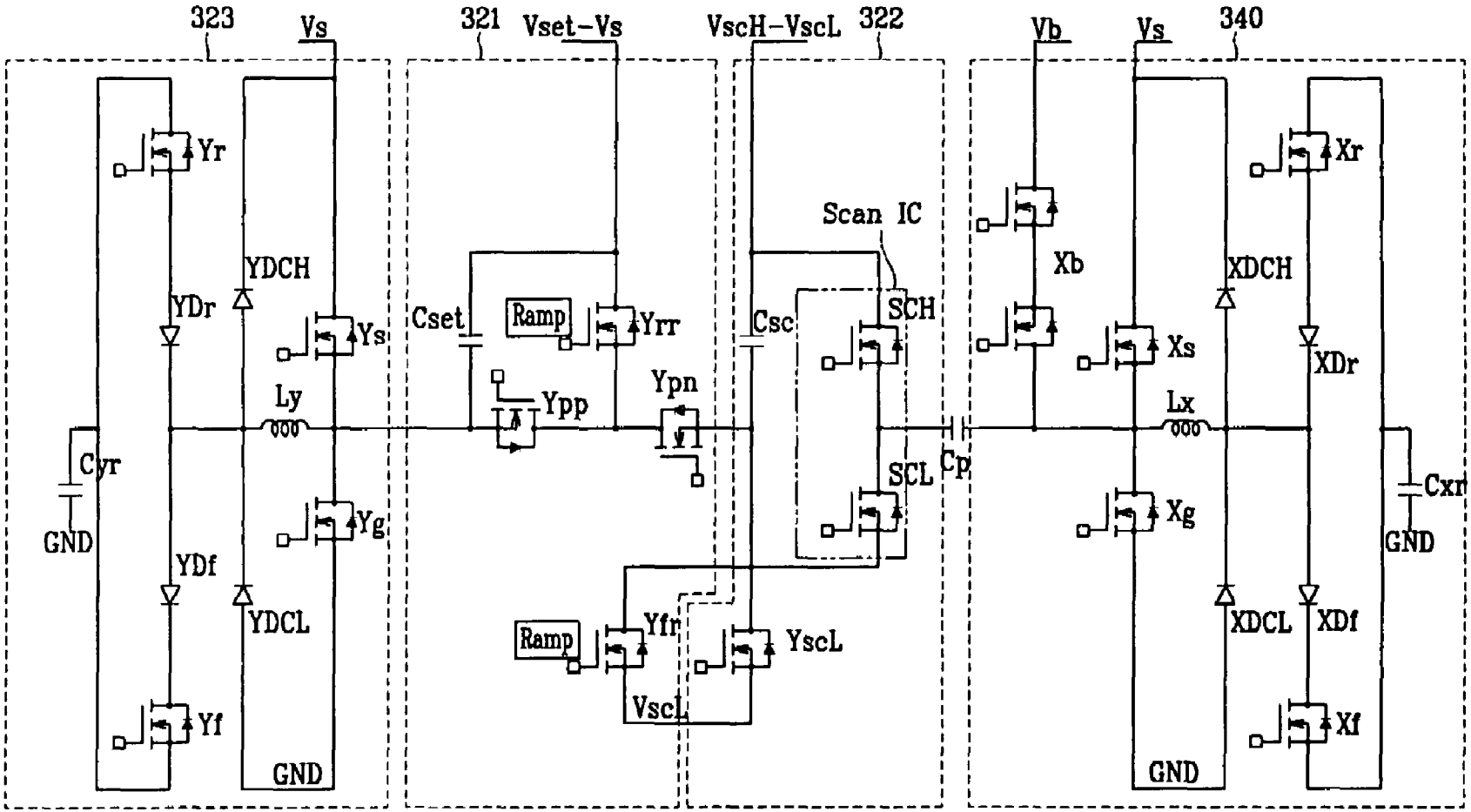
FIG. 5 is a detailed circuit diagram of X and Y electrode drivers of the PDP according to a first embodiment of the present invention.

FIG. 5 is a detailed circuit diagram of the X and Y electrode drivers 340 and 320 of the PDP according to a first embodiment of the present invention.

As shown in FIG. 5, a circuit for driving the PDP according to the first embodiment of the present invention includes the X electrode driver 340 and the Y electrode driver 320. The Y electrode driver 320 includes a reset driver 321, a scan driver 322 and a sustain driver 323.

The reset driver 321 includes a rising ramp generator for generating a rising reset waveform during a reset period. The rising ramp generator includes a voltage source Vset-Vs for supplying a voltage Vset-Vs, a capacitor Cset operated with a floating voltage, a ramp switch Yrr, and a switch Ypp for preventing a reverse flow of current. The switch Ypp is arranged on a main path along which a sustain discharge voltage generated by the sustain driver 323 is supplied to a panel capacitor Cp. The reset driver 321 further includes a falling ramp generator for generating a falling reset waveform during the reset period. The falling ramp generator includes a ramp switch Yfr connected to a voltage source VscL, and a switch Ypn for preventing a reverse flow of current. The switch Ypn is arranged on the main path along which the sustain discharge voltage is supplied to the panel capacitor Cp.

Before the reset period, the capacitor Cset is charged with the voltage Vset-Vs supplied from the voltage source Vset-Vs when a switch Yg is turned on. At the beginning of the reset period, a switch Ys is turned on to supply a voltage Vs to a Y electrode of the panel capacitor Cp. Subsequently, when the switch Yrr is turned on, a voltage of the panel capacitor Cp gradually rises to a voltage Vset due to the charging of the capacitor Cset.

Thereafter, the switch Ys is turned on and the switch Yrr is turned off, thereby causing the voltage Vs to be supplied to the Y electrode. When the switch Yfr is turned on, the voltage at the Y electrode gradually falls to a voltage VscL.

The scan driver 322 generates a scan pulse in an address period and includes the voltage source VscL, a voltage source VscH-VscL, a capacitor Csc, a switch YscL, and a scan IC. The scan IC includes switches SCH and SCL. The source of the switch SCH and the drain of the switch SCL are connected in common to the Y electrode of the panel capacitor Cp.

During the address period, the switch YscL always remains on. When the Y electrode is selected, the switch SCL is turned on to supply the voltage VscL to the Y electrode. However, when the Y electrode is not selected, a voltage stored in the capacitor Csc by the voltage source VscH-VscL is supplied to the Y electrode through the switch SCH.

The sustain driver 323 generates a sustain discharge pulse during a sustain period, and includes the switches Ys and Yg connected between a voltage source Vs and a ground terminal GND, a capacitor Cyr and switches Yr and Yf for power recovery, an inductor Ly, and diodes YDr, YDf, YDCH and YDCL.

A voltage Vs/2 is stored in the capacitor Cyr before the sustain period. During the sustain period, when the switch Yr is turned on, resonance occurs between the inductor Ly and the panel capacitor Cp, thereby causing the panel capacitor Cp to be charged. Thereafter, the voltage Vs is continuously supplied to the panel capacitor Cp through the switch Ys. Also, when the switch Yf is turned on, resonance occurs between the inductor Ly and the panel capacitor Cp, thereby causing the panel capacitor Cp to be discharged. Thereafter, the voltage of the panel capacitor Cp is maintained at 0V through the switch Yg.

The diodes YDr and YDf are arranged in opposite directions to body diodes of the switches Yr and Yf to respectively block the flows of currents resulting from the body diodes. The diodes YDCH and YDCL act to respectively clamp the voltage Vs and a secondary voltage of the inductor Ly.

The X electrode driver 340 includes a voltage source Vb and switch Xb for generating an erase pulse to be supplied to an X electrode of the panel capacitor Cp during the reset period, switches Xs and Xg connected between the voltage source Vs and the ground terminal GND for generating a sustain discharge pulse during the sustain period, a capacitor Cxr and switches Xr and Xf for power recovery, an inductor Lx, and diodes XDr, XDf, XDCH and XDCL.

The switches Xs and Xg, capacitor Cxr, switches Xr and Xf, inductor Lx and diodes XDr, XDf, XDCH and XDCL of the X electrode driver 340 perform the same functions as those of the switches Ys and Yg, capacitor Cyr, switches Yr and Yf, inductor Ly and diodes YDr, YDf, YDCH and YDCL of the sustain driver 323 of the Y electrode driver 320, respectively, and a description thereof has been omitted.

The panel capacitor Cp is an equivalent expression of a capacitance component between the associated X and Y electrodes.

In FIG. 5, the switches of the respective parts are shown to be n-channel MOSFETs for illustrative purposes, and may include body diodes.

A process of supplying a scan pulse and sustain discharge pulse to the panel capacitor Cp by the driving circuit according to the first embodiment of the present invention will hereinafter be described with reference to FIGS. 6 and 7.

Figure 6:
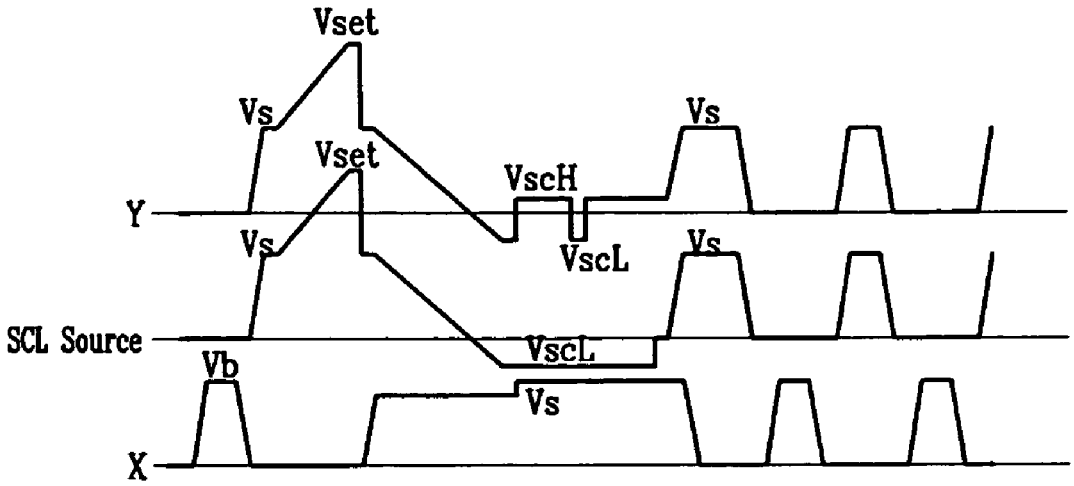
FIG. 6 is a waveform diagram of driving waveforms of the PDP according to the first embodiment of the present invention.
Figure 7:
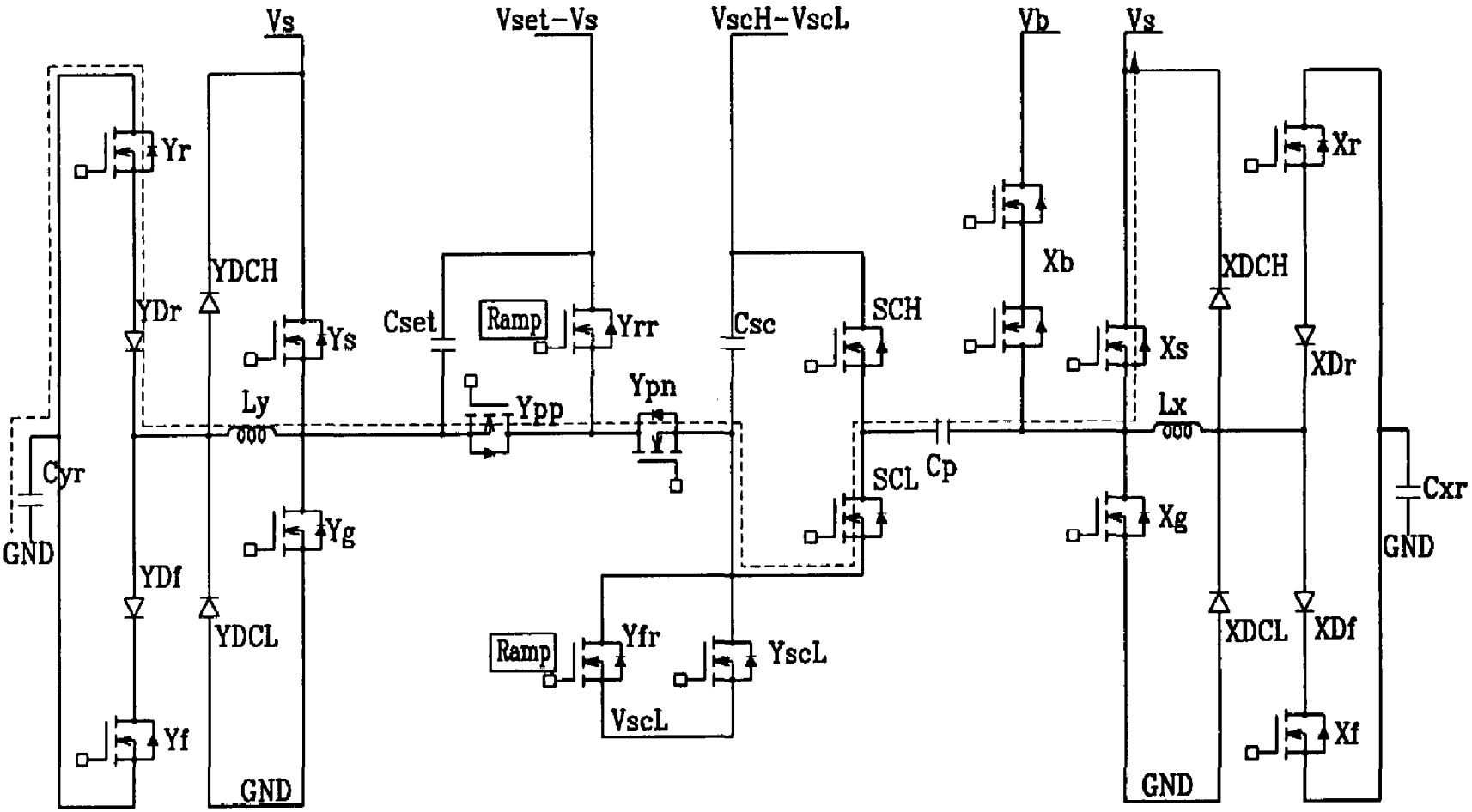
FIG. 7 is a circuit diagram of a current path when the driving waveforms according to the first embodiment of the present invention are supplied.

FIG. 6 is a waveform diagram of driving waveforms of the PDP according to the first embodiment of the present invention, and FIG. 7 is a circuit diagram illustrating a current path when the driving waveforms according to the first embodiment of the present invention are supplied.

As shown in FIG. 6, in the first embodiment of the present invention, when a driving operation moves from the address period to the sustain period, both the switches SCH and SCL of the scan IC are turned off to float the Y electrode and to supply a sustain discharge voltage to the Y electrode in the floated state.

That is, as shown in FIG. 7, during the address period, the switch YscL remains on, and a scan pulse is supplied to the Y electrode through on/off operations of the switches SCH and SCL. When a scan operation is completed, the switch SCH is turned on and the switch SCL is turned off. In this state, the switch SCH is turned off to float the output of the scan IC to the Y electrode. As a result, the Y electrode is maintained at a voltage VscH, as shown in FIG. 6.

When the switch YscL is turned off and the switch Ypn is turned on, the source voltage of the switch SCL becomes a base level of the sustain discharge voltage, 0V, along a path of body diode of switch Yg—body diode of switch Ypp—switch Ypn.

Thereafter, when the switch Yr is turned on, a path of capacitor Cyr—switch Yr—inductor Ly—body diode of switch Ypp—switch Ypn—body diode of switch SCL—panel capacitor Cp is formed as shown in FIG. 7. As a result, the voltage at the Y electrode rises to the voltage Vs due to resonance between the inductor Ly and the panel capacitor Cp, as shown in FIG. 6. The source voltage of the switch SCL also rises to the voltage Vs in the same manner as the Y electrode voltage.

A sustain discharge operation is performed after the switch SCL is turned on in this state. Namely, the Y electrode voltage is maintained at the sustain discharge voltage Vs by turning off the switch Yr of the Y electrode driver 320 and turning on the switch Ys thereof.

Also, the switch Xf of the X electrode driver 340 is turned on to slowly reduce a voltage at the X electrode to 0V due to resonance between the panel capacitor Cp and the inductor Lx. Alternatively, the switch Xg may be turned on instead of the switch Xf to apply a voltage of 0V directly to the X electrode.

When the switches Ys and Ypn are turned off and the switches Ypp and Yf are turned on under the condition that the switch SCL is on, a path of panel capacitor Cp—switch SCL—body diode of switch Ypn—switch Ypp—switch Yf—capacitor Cyr is formed. Hence, the Y electrode voltage falls from the voltage Vs to 0V due to resonance between the inductor Ly and panel capacitor Cp, as shown in FIG. 6.

The Y electrode voltage is maintained at 0V by turning the switch Yf off and the switch Yg on in this state.

As described above, according to the first embodiment of the present invention, the drain voltage and source voltage of the switch SCL are equal when the sustain discharge voltage is supplied to the Y electrode. For this reason, no current flows in switches SCL of all of the scan ICs even though they are turned on at the same time. Therefore, it is possible to solve instability of the driving circuit and noise and EMI therein.

Although the Y electrode driver has been used in the first embodiment of the present invention to make the drain voltage and source voltage of the switch SCL equal, the X electrode driver may be used alternatively to obtain the same result.

A method of driving the PDP according to a second embodiment of the present invention will hereinafter be described in detail with reference to FIGS. 8 and 9.

Figure 8:
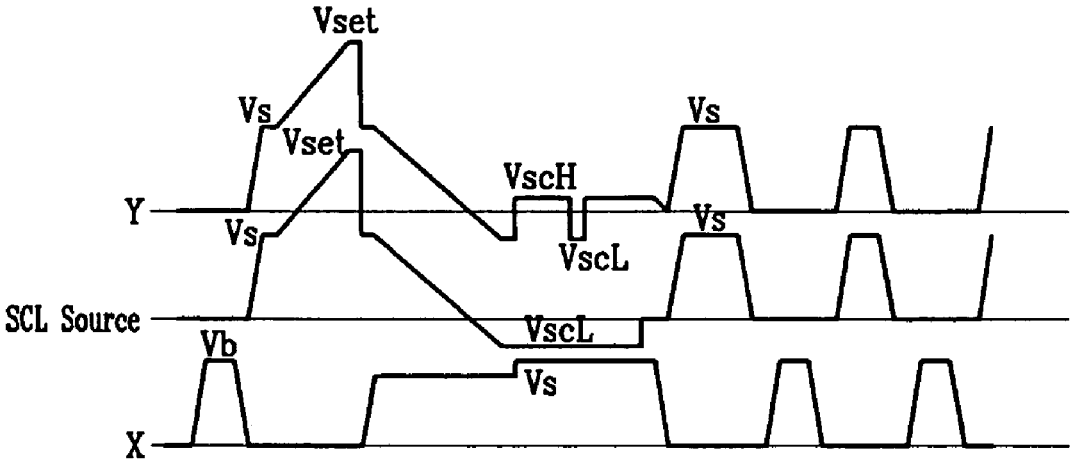
FIG. 8 is a waveform diagram of driving waveforms of a PDP according to a second embodiment of the present invention.
Figure 9:
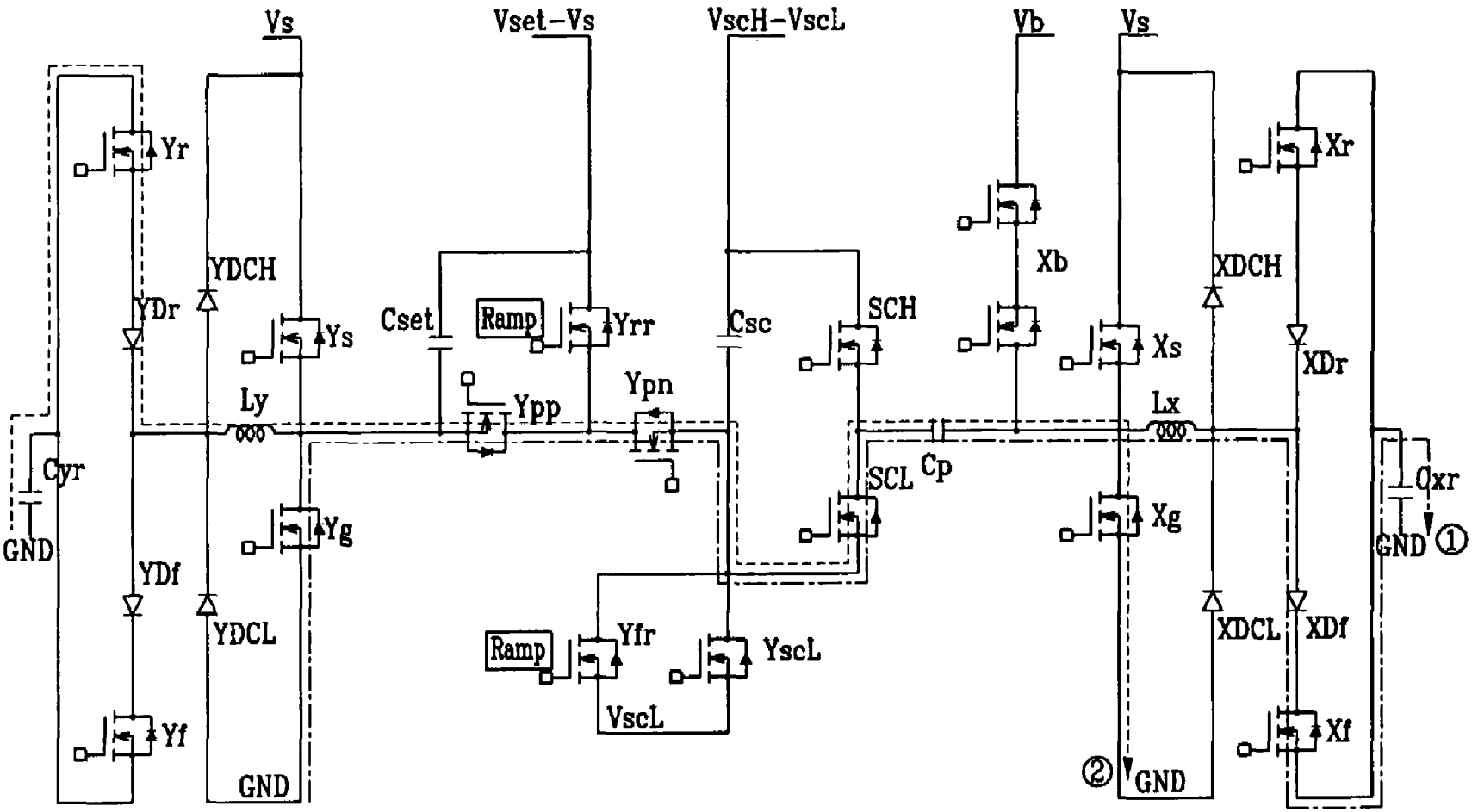
FIG. 9 is a circuit diagram of a current path when the driving waveforms according to the second embodiment of the present invention are supplied.

FIG. 8 is a waveform diagram of driving waveforms of the PDP according to the second embodiment of the present invention, and FIG. 9 is a circuit diagram illustrating a current path when the driving waveforms according to the second embodiment of the present invention are supplied.

As shown in FIG. 8, in the second embodiment of the present invention, when a driving operation moves from the address period to the sustain period, the Y electrode voltage is floated to the voltage VscH and then reduced to 0V through the power recovery circuit of the X electrode driver and, thereafter, a sustain discharge voltage is supplied to the Y electrode.

That is, at the time that a scan operation is completed, the switch SCH is turned on and the switch SCL is turned off. In this state, the switch SCH is turned off to float the output of the scan IC to the Y electrode. As a result, the Y electrode is maintained at the voltage VscH, as shown in FIG. 8.

If the switch YscL is turned off and the switch Ypn is turned on, the source voltage of the switch SCL becomes a base level of the sustain discharge voltage, 0V, along a path of body diode of switch Yg—body diode of switch Ypp—switch Ypn.

Thereafter, when the switch Xf is turned on under the condition that the switch Ypn is on, a path (path ① of FIG. 9) of body diode of switch Yg—switch Ypn—body diode of switch Ypp—body diode of switch SCL—panel capacitor Cp—inductor Lx—switch Xf—capacitor Cxr is formed as shown in FIG. 9. As a result, the voltages at the X and Y electrodes fall to 0V due to resonance between the inductor Lx and the panel capacitor Cp, as shown in FIG. 8. At this time, because the switch SCL remains off, the source voltage thereof is maintained at 0V as shown in FIG. 8.

A sustain discharge operation is performed after the switch SCL is turned on in this state. Namely, if the switch Yr of the Y electrode driver is turned on, a path (path ② of FIG. 9) of switch Yr—inductor Ly—body diode of switch Ypp—switch Ypn—body diode of switch SCL—panel capacitor Cp is formed as shown in FIG. 9. Accordingly, the voltage at the Y electrode slowly rises to the sustain discharge voltage Vs due to resonance between the inductor Ly and the panel capacitor Cp. The source voltage of the switch SCL also slowly rises to the sustain discharge voltage Vs in the same manner as the Y electrode voltage.

At this time, since the voltage at the X electrode is in the state of having been lowered to 0V by the path ① of FIG. 9, it is maintained at 0V by turning off the switch Xf of the X electrode driver and turning on the switch Xg thereof when the voltage at the Y electrode rises to the voltage Vs.

The voltage at the Y electrode is maintained at the sustain discharge voltage Vs by turning off the switch Yr of the Y electrode driver and turning on the switch Ys thereof after turning on the switch SCL in the above state.

Thereafter, when the switches Ys and Ypn are turned off and the switches Ypp and Yf are turned on under the condition that the switch SCL is on, a path of panel capacitor Cp—switch SCL—body diode of switch Ypn—switch Ypp—switch Yf—capacitor Cyr is formed. As a result, the Y electrode voltage falls from the voltage Vs to 0V due to resonance between the inductor Ly and panel capacitor Cp, as shown in FIG. 8.

The Y electrode voltage is maintained at 0V by turning the switch Yf off and the switch Yg on in this state.

As stated above, according to the second embodiment of the present invention, the drain voltage and source voltage of the switch SCL are equal when the sustain discharge voltage is supplied to the Y electrode, similarly to the first embodiment of the present invention. For this reason, no current flows in switches SCL of all of the scan ICs even though they are turned on at the same time. Therefore, it is possible to solve instability of the driving circuit and noise and EMI therein.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

For example, although the voltage +Vs and the voltage GND are alternately supplied to the panel capacitor during the sustain period in the first and second embodiments of the present invention, the voltage +Vs and the voltage −Vs may be supplied for the sustain discharge.

As is apparent from the above description, according to the present invention, when a driving operation moves from an address period to a sustain period, low-voltage driving switches of all of the scan ICs are turned on at the same time after the drain voltage and source voltage of each of them are made to be equal through a power recovery circuit under the condition that the outputs of the scan ICs are floated. Therefore, when the switches are turned on, no current flows therethrough, thereby making it possible to solve instability of a driving circuit and noise and EMI therein.

What is claimed is:

1. A method of driving a Plasma Display Panel (PDP), the method comprising:

providing a plurality of first electrodes and a plurality of second electrodes;

sequentially selecting the plurality of first electrodes and supplying a first voltage to a selected one of the first electrodes and a second voltage to all of the other first electrodes;

then floating the first electrodes after the second voltage has been supplied to the first electrodes; and then changing a voltage at each of the first electrodes to a third voltage for a sustain discharge;

wherein changing a voltage at each of the first electrodes to a third voltage for a sustain discharge includes maintaining a voltage at each of the second electrodes at a fourth voltage, and wherein the fourth voltage is supplied to the second electrodes upon the first electrodes being selected;

the method further comprising:

between floating the first electrodes while supplying the second voltage to the first electrodes and changing a voltage at each of the first electrodes to a third voltage for a sustain discharge, changing the voltage at each of the second electrodes from the fourth voltage to a fifth voltage; and changing the voltage at each of the first electrodes from the second voltage to the fifth voltage.

2. The method of claim 1, further comprising:

supplying the fourth voltage to the second electrodes upon the first electrodes being selected;

wherein the fifth voltage is a voltage whose difference with respect to the third voltage supplied to the first electrodes causes the sustain discharge.

3. A method of driving a Plasma Display Panel (PDP), the method comprising:

providing a plurality of first electrodes, a plurality of second electrodes, and a plurality of selection circuits respectively coupled to the first electrodes, wherein each of the selection circuits includes a first transistor having a source or drain coupled to a corresponding one of the first electrodes, and a second transistor having a source or drain coupled to the corresponding first electrode;

sequentially selecting the first electrodes, and supplying a first voltage to a selected one of the first electrodes through a body diode of a corresponding one of the second transistors and respectively supplying a second voltage to all of the other first electrodes through body diodes of corresponding ones of the first transistors;

turning off the first and second transistors of the selection circuits;

respectively supplying a third voltage adapted to cause a sustain discharge to the first electrodes through body diodes of the second transistors; and turning on the second transistors of the selection circuits;

wherein the first voltage is supplied to the selected first electrode upon the corresponding second transistor being turned on; and wherein the second voltage is supplied to all of the other first electrodes upon the corresponding first transistors being turned on.

4. The method of claim 3, wherein respectively supplying a third voltage adapted to cause a sustain discharge to the first electrodes through body diodes of the second transistors includes maintaining a voltage at each of the second electrodes at a fourth voltage, wherein the fourth voltage is supplied to the second electrodes upon the first electrodes being selected.

5. The method of claim 4, further comprising, after respectively supplying a third voltage to cause a sustain discharge to the first electrodes through body diodes of the second transistors, changing the voltage at each of the second electrodes from the fourth voltage to a fifth voltage, wherein the fifth voltage is a voltage whose difference with the third voltage supplied to the first electrodes causes the sustain discharge.

6. The method of claim 4, further comprising:

between turning off the first and second transistors of the selection circuits and respectively supplying a third voltage to cause a sustain discharge to the first electrodes through body diodes of the second transistors, changing the voltage at each of the second electrodes from the fourth voltage to a fifth voltage; and changing a voltage at each of the first electrodes from the second voltage to the fifth voltage.

7. The method of claim 3, wherein turning on the second transistors of the selection circuits includes turning on each of the second transistors while the voltage at each of the first electrodes is maintained at the third voltage.

8. The method of claim 6, wherein turning on the second transistors of the selection circuits includes setting a source voltage and drain voltage of each of the second transistors to be equal when each of the second transistors is turned on.

9. A Plasma Display Panel (PDP) drive apparatus comprising:

a plurality of first electrodes, a plurality of second electrodes, and a panel capacitor formed by each of the first electrodes and each of the second electrodes;

a first sustain driver adapted to supply a voltage for a sustain discharge to the first electrodes;

a plurality of selection circuits adapted to sequentially supply a scan voltage to the first electrodes during an address period, each of the selection circuits including a first transistor having a first terminal coupled to a corresponding one of the first electrodes and a second terminal, and a second transistor having a first terminal and a second terminal coupled to the corresponding first electrode;

a first voltage source adapted to respectively supply the scan voltage to the first electrodes through the second transistors; and a second voltage source adapted to respectively supply a first voltage to ones of the first electrodes other than a first electrode supplied with the scan voltage in the address period, through corresponding ones of the first transistors;

wherein the sustain discharge voltage is supplied to the first electrodes through the first sustain driver and respective body diodes of the second transistors;

wherein the second transistors are then turned on after the first and second transistors have been turned off after sequentially supplying the scan voltage to the first electrodes;

wherein the first voltage is then supplied to the first electrodes by the second transistors being turned on; and wherein the first sustain driver includes:

a first inductor having a first end coupled to the second terminal of each of the second transistors;

a third transistor coupled between a second end of the first inductor and a third voltage source adapted to supply a second voltage; and a fourth transistor coupled between each of the first electrodes and a fourth voltage source adapted to supply a third voltage;

wherein the first electrodes are charged upon the third transistor being turned on when the first and second transistors are turned off; and wherein the third voltage is then supplied to the first electrodes upon the fourth transistor being turned on.

10. The apparatus of claim 9, wherein the second electrodes are maintained at a fourth voltage while the first electrodes are charged to the third voltage, and wherein the fourth voltage is supplied to the second electrodes during the address period.

11. The apparatus of claim 9, further comprising a second sustain driver adapted to supply a voltage for a sustain discharge to the second electrodes, the second sustain driver including;

a second inductor having a first end coupled to each of the second electrodes;

a fifth transistor coupled between a second end of the second inductor and a fifth voltage source adapted to supply a fifth voltage; and a sixth transistor coupled between each of the second electrodes and a sixth voltage source adapted to supply a sixth voltage;

wherein the second electrodes are discharged upon the fifth transistor being turned on when the first and second transistors are turned off;

wherein the sixth voltage is supplied to the second electrodes upon the sixth transistor being turned on; and wherein the third voltage is then supplied to the first electrodes upon the third transistor being turned on.

12. The apparatus of claim 9, further comprising:

a first diode coupled between the second end of the first inductor and the third voltage source to determine a direction of current to charge the panel capacitor; and a second diode coupled between the second end of the second inductor and the fifth voltage source to determine a direction of current to discharge the panel capacitor.

* * * * *